US008630562B2

(12) United States Patent
Tokunaga et al.

(10) Patent No.: US 8,630,562 B2
(45) Date of Patent: Jan. 14, 2014

(54) IMAGE FORMING APPARATUS

(75) Inventors: Masaaki Tokunaga, Kanagawa (JP); Masatoshi Yamada, Kanagawa (JP); Kiyotoshi Kaneyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 227 days.

(21) Appl. No.: 13/149,416

(22) Filed: May 31, 2011

(65) Prior Publication Data

US 2012/0114369 A1 May 10, 2012

(30) Foreign Application Priority Data

Nov. 9, 2010 (JP) ..... 2010-250758

(51) Int. Cl.
*G03G 15/16* (2006.01)

(52) U.S. Cl.
USPC ..... 399/101; 399/149; 399/249

(58) Field of Classification Search
USPC ..... 399/99, 101, 149, 249
See application file for complete search history.

(56) References Cited

U.S. PATENT DOCUMENTS 7,043,172 B2 * 5/2006 Koshimura et al. ..... 399/99
2011/0142486 A1 * 6/2011 Komiyama et al. ..... 399/101

FOREIGN PATENT DOCUMENTS

JP 4086175 B2 7/2002
JP 2002278312 A * 9/2002 ..... G03G 15/16

* cited by examiner

*Primary Examiner* — Clayton E Laballe
*Assistant Examiner* — Michael Harrison
(74) *Attorney, Agent, or Firm* — Sughrue Mion, PLLC

(57) ABSTRACT

An image forming apparatus includes a transfer member that retains developer; a housing provided with a removing member that removes the developer and having an intake opening that is opposed to the transfer member, the developer removed by the removing member being taken into the housing through the intake opening; a guiding pipe connected to the housing and having a suction hole through which the developer is sucked and an outlet through which the developer is discharged; and a suction member that applies a suction force to an inner space of the housing through the guiding pipe. A capturing area for capturing the developer that flows through a flow channel from the suction hole to the outlet is provided in the flow channel. A cross section of the capturing area in a radial direction of the flow channel is larger than that of other areas.

20 Claims, 10 Drawing Sheets

IMAGE FORMING APPARATUS

CROSS-REFERENCE TO RELATED APPLICATIONS

This application is based on and claims priority under 35 USC 119 from Japanese Patent Application No. 2010-250758 filed Nov. 9, 2010.

BACKGROUND (i) Technical Field

The present invention relates to an image forming apparatus.

(ii) Related Art

Image forming apparatuses, such as copy machines and printers, that form images by electrophotography are known. An example of such an image forming apparatus forms an image on a recording medium, such as a sheet of printing paper, by transferring a toner image formed on a photoconductor onto an intermediate transfer body (first transfer process) and then transferring the toner image onto the recording medium.

A cycle method (four-cycle method when four colors of toners are used) is an example of a method for forming a full-color image with the structure including the intermediate transfer body. In the cycle method, toner images of respective colors, such as yellow (Y), magenta (M), cyan (C), and black (K), that correspond to a single full-color image are successively formed by a single image forming unit. The toner images of the respective colors are successively transferred, one toner image in each cycle, onto the intermediate transfer body. Thus, the toner images are superimposed on a transfer belt (transfer member).

The image forming apparatus that uses the cycle method includes a cleaning device for removing toner (an example of developer) that remains on the transfer belt. A blade-shaped cleaning member (removing member) included in the cleaning device is separated from the transfer belt during the image forming process, and is brought into contact with the transfer belt when the first transfer process is ended.

SUMMARY

According to an aspect of the invention, there is provided an image forming apparatus including a transfer member that retains developer; a housing provided with a removing member that removes the developer, the housing having an intake opening that is opposed to the transfer member, the developer removed by the removing member being taken into the housing through the intake opening; a guiding pipe connected to the housing and having a suction hole through which the developer that has been taken into the housing is sucked and an outlet through which the developer that has been sucked is discharged; and a suction member that applies a suction force to an inner space of the housing through the guiding pipe. A capturing area for capturing the developer that has been sucked by the suction member and that flows through a flow channel from the suction hole to the outlet of the guiding pipe is provided at an intermediate position of the flow channel, a cross section of the capturing area in a radial direction of the flow channel being larger than a cross section of other areas.

BRIEF DESCRIPTION OF THE DRAWINGS

An exemplary embodiment of the present invention will be described in detail based on the following figures, wherein.

DETAILED DESCRIPTION

Figure 1:
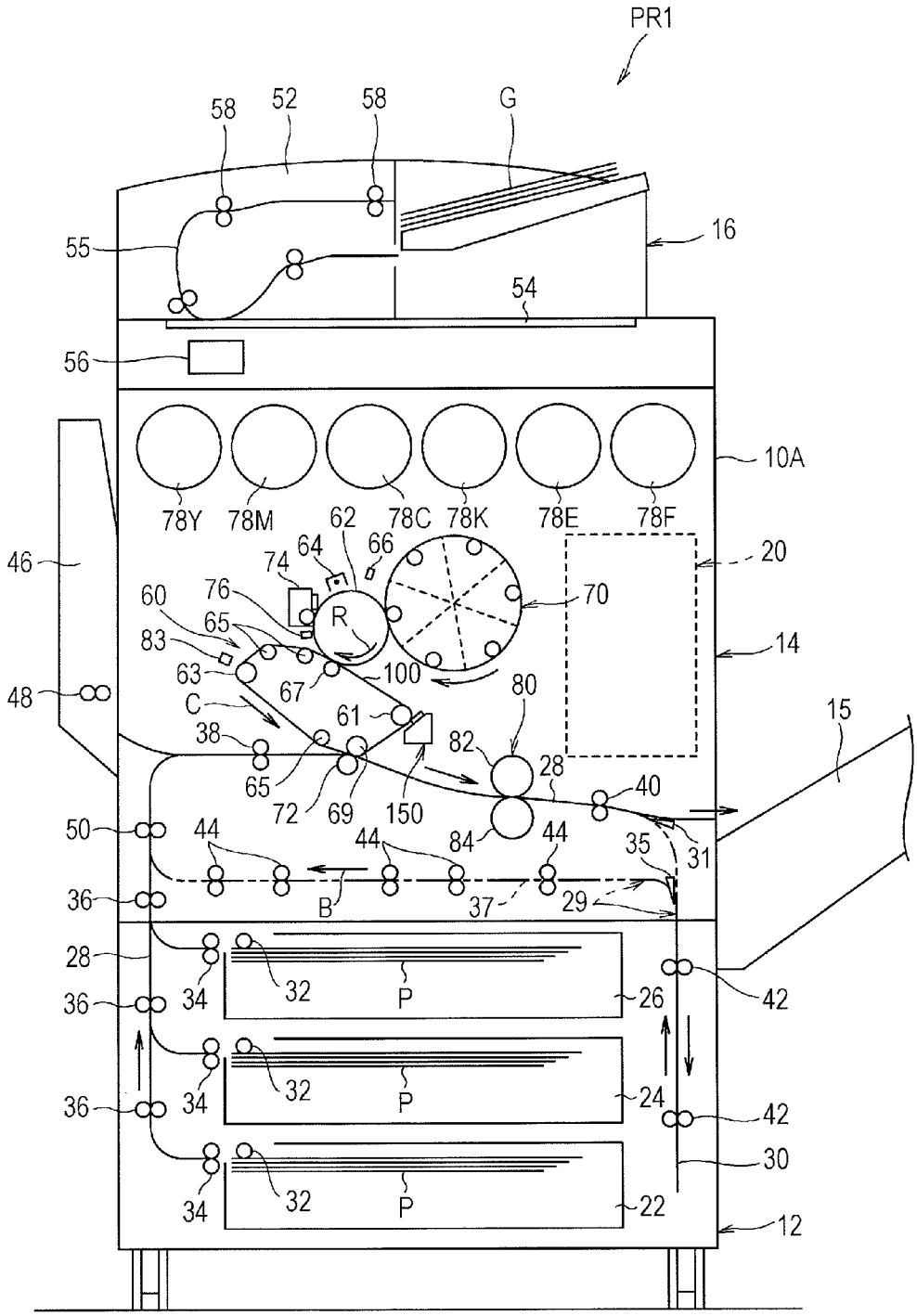
FIG. 1 is a schematic diagram illustrating the structure of an image forming apparatus according to an exemplary embodiment of the present invention.

An exemplary embodiment of the present invention will be described in detail below with reference to the accompanying drawings. In the drawings, the same components are denoted by the same reference numerals, and redundant explanations are omitted. The exemplary embodiment described herein is the best mode for carrying out the present invention, and the present invention is not limited thereto.

Referring to FIG. 1, the overall structure of an image forming apparatus PR1 according to the present exemplary embodiment includes, in order from bottom to top in the vertical direction, a sheet storing unit 12 in which recording paper P is stored; an image forming unit 14 which is located above the sheet storing unit 12 and forms images on sheets of recording paper P fed from the sheet storing unit 12; and an original-document reading unit 16 which is located above the image forming unit 14 and reads an original document G. The image forming apparatus PR1 also includes a controller 20 that is provided in the image forming unit 14 and controls the operation of each part of the image forming apparatus PR1.

The sheet storing unit 12 includes a first storage unit 22, a second storage unit 24, and a third storage unit 26 in which sheets of recording paper P having different sizes are stored.

Each of the first storage unit 22, the second storage unit 24, and the third storage unit 26 are provided with a feeding roller 32 that feeds the stored sheets of recording paper P to a transport path 28 in the image forming apparatus PR1.

Pairs of transporting rollers 34 and 36 that transport the sheets of recording paper P one at a time are provided along the transport path 28 in an area on the downstream of each feeding roller 32.

In addition, a pair of transporting rollers 50 are provided downstream of the transporting rollers 36 near the third storage unit 26. The transporting rollers 50 are arranged to guide the sheets of recording paper P that have been transported from a reverse transport path 29, which will be described below, into the transport path 28.

A pair of positioning rollers 38 are provided downstream of the transporting rollers 50. The positioning rollers 38 temporarily stops each sheet of recording paper P and feeds the sheet toward a second transfer position, which will be described below, at a predetermined timing.

A part of the transport path 28 that is upstream of the transporting rollers 50 extends vertically along a straight line. A downstream part of the transport path 28 including the positioning rollers 38 extends from the left side to the right side of the image forming unit 14. More specifically, the downstream part of the transport path 28 extends along a substantially straight line to a paper output unit 15 provided on the right side of an apparatus body 10A. The reverse transport path 29, which is provided for reversing and transporting the sheets of recording paper P, is located below the downstream part of the transport path 28 including the positioning rollers 38.

The reverse transport path 29 includes a first guiding member 31 that guides the sheets of recording paper P from the transport path 28 to the reverse transport path 29; a reversing unit 30 which extends vertically along a straight line from the lower right area of the image forming unit 14 to the lower right area of the sheet storing unit 12; a second guiding member 35 that guides the sheets of recording paper P that have been transported by the reversing unit 30 from the reversing unit 30 to a transporting unit 37, which will be described below; and the transporting unit 37 that transports the sheet of recording paper P guided by the second guiding member 35.

A downstream part of transporting unit 37 joins the transport path 28 in the area between the transporting rollers 36 near the third storage unit 26 and the transporting rollers 50. The reversing unit 30 is provided with plural pairs of transporting rollers 42 that are arranged with predetermined intervals therebetween, and the transporting unit 37 is provided with plural pairs of transporting rollers 44 that are arranged with predetermined intervals therebetween.

The first guiding member 31 has a substantially triangular prism shape, and a point end of the first guiding member 31 is moved by a driving unit (not shown) to one of the transport path 28 and the reverse transport path 29. Thus, each sheet of recording paper P is guided along one of the transport path 28 and the reverse transport path 29.

Similarly, the second guiding member 35 has a substantially triangular prism shape, and a point end of the second guiding member 35 is moved by a driving unit (not shown) to one of the reversing unit 30 and the transporting unit 37. Thus, each sheet of recording paper P is guided along one of the reversing unit 30 and the transporting unit 37.

A foldable manual sheet-feeding unit 46 is provided on the left side of the apparatus body 10A. When a sheet of recording paper P is supplied from the manual sheet-feeding unit 46, the sheet is transported by transporting rollers 48 and is inserted into the transport path 28 at a position downstream of the transporting rollers 50 and upstream of the positioning rollers 38.

The original-document reading unit 16 includes a document transport device 52 that automatically transports the sheets of the original document G one at a time; a platen glass 54 which is located below the document transport device 52 and on which the sheets of the original document G are placed one at a time; and an original-document reading device 56 that scans each sheet of the original document G while the sheet is being transported by the document transport device 52 or placed on the platen glass 54.

The document transport device 52 includes an automatic transport path 55 along which pairs of transporting rollers 58 are arranged. A part of the automatic transport path 55 is arranged such that each sheet of the original document G moves along the top surface of the platen glass 54. The original-document reading device 56 scans each sheet of the original document G that is being transported by the document transport device 52 while being stationary at the left edge of the platen glass 54. Alternatively, the original-document reading device 56 scans each sheet of the original document G placed on the platen glass 54 while moving rightward.

The image forming unit 14 includes a cylindrical photoconductor 62 arranged in a substantially central area of the apparatus body 10A such that an axial direction thereof extends in the front-back direction of the apparatus body 10A.

The photoconductor 62 is rotated in the direction shown by arrow R (clockwise in FIG. 1) by a driving unit (not shown), and carries an electrostatic latent image formed by irradiation with light. In addition, a corotron charging member 64 that charges the surface (outer peripheral surface) of the photoconductor 62 is provided above the photoconductor 62 so as to face the surface of the photoconductor 62.

An exposure device 66 is provided so as to face the surface of the photoconductor 62 at a position downstream of the charging member 64 in the rotational direction of the photoconductor 62. The exposure device 66 includes a light emitting diode (LED). The surface of the photoconductor 62 that has been charged by the charging member 64 is irradiated with light (exposed to light) by the exposure device 66 on the basis of an image signal corresponding to each color of toner. Thus, an electrostatic latent image is formed.

The exposure device 66 is not limited to those including the LED. For example, the exposure device 66 may be structured such that the surface of the photoconductor 62 is scanned with a laser beam by using a polygon mirror. A rotation-switching developing device 70 is provided downstream of a position where the photoconductor 62 is irradiated with light by the exposure device 66 in the rotational direction of the photoconductor 62. The developing device 70 visualizes the electrostatic latent image on the surface of the photoconductor 62 by developing the electrostatic latent image with toner (an example of developer) of each color.

The developing device 70 includes developing units (not shown) corresponding to the respective colors, which are yellow (Y), magenta (M), cyan (C), black (K), a first specific color (E), and a second specific color (F). The developing device 70 is of a rotary type, and the developing units are arranged in a circumferential direction. The developing device 70 is rotated by a motor (not shown), which functions as a rotational drive source, in steps of 60°. Accordingly, one of the developing units is selectively opposed to the surface of the photoconductor 62.

The first specific color (E) and the second specific color (F) are selected from, for example, specific colors (including transparent) other than yellow (Y), magenta (M), cyan (C), and black (K). When the first specific color (E) and the second specific color (F) are both used, an image is formed using six colors, which are Y, M, C, K, E, and F.

Alternatively, an image may be formed using five colors including Y, M, C, K, and one of the first specific color (E) and the second specific color (F), or using four colors excluding the first specific color (E) and the second specific color (F).

An intermediate transfer unit 60, which is an example of a transfer device, is provided downstream of the developing device 70 in the rotational direction of the photoconductor 62 and below the photoconductor 62. A toner image formed on the surface of the photoconductor 62 is transferred onto the intermediate transfer unit 60 in a first transfer process.

The intermediate transfer unit 60 includes an endless transfer belt 100 (intermediate transfer belt, an example of a transfer member). The transfer belt 100 serves as an example of an image carrying member, and rotates in the direction shown by arrow C (counterclockwise in FIG. 1).

The transfer belt 100 is wound around a driving roller 61 (an example of a rotating body) that is rotated by the controller 20; a tension-applying roller 63 (an example of a rotating body) that applies a tension to the transfer belt 100; plural transporting rollers 65 (examples of rotating bodies) that are in contact with the back surface (inner peripheral surface) of the transfer belt 100 and are rotationally driven; and an auxiliary roller 69 (an example of a rotating body) that is in contact with the back surface of the transfer belt 100 at the second transfer position, which will be described below, and is rotationally driven.

A first transfer roller 67 is opposed to the photoconductor 62 with the transfer belt 100 interposed therebetween. The first transfer roller 67 transfers the toner image formed on the surface of the photoconductor 62 onto the surface (outer peripheral surface) of the transfer belt 100.

The first transfer roller 67 is in contact with the back surface of the transfer belt 100 at a position downstream of the position where the photoconductor 62 is in contact with the transfer belt 100 in the moving direction of the transfer belt 100.

The first transfer roller 67 receives electricity from a power source (not shown), so that a potential difference is generated between the first transfer roller 67 and the photoconductor 62, which is grounded. Thus, the first transfer process is carried out in which the toner image on the photoconductor 62 is transferred onto the surface of the transfer belt 100.

A cleaning device 74 is provided downstream of the first transfer roller 67 in the rotational direction of the photoconductor 62. The cleaning device 74 removes residual toner (an example of developer) and the like that remain on the surface of the photoconductor 62 instead of being transferred onto the surface of the transfer belt 100 in the first transfer process. A discharge device 76 is provided upstream of the cleaning device 74 and downstream of the first transfer roller 67 in the rotational direction of the photoconductor 62. The discharge device 76 removes the electric charge by irradiating the surface of the photoconductor 62 with light.

A reference mark made of a reflective seal or the like that shows a reference position for positioning an image is formed on an end portion of the transfer belt 100, and a photosensor 83 is disposed so as to face the transfer belt 100 at a position where the reference mark passes.

As illustrated in FIG. 1, a fixing device 80 is provided downstream of the second transfer position. The fixing device 80 fixes the toner images that have been transferred onto the sheet of recording paper P by the second transfer roller 72. The fixing device 80 includes a heating roller 82 and a pressing roller 84. The heating roller 82 includes a heat source which generates heat when electricity is supplied thereto, and is disposed at the side of the sheet of recording paper P at which the toner images are formed (upper side). The pressing roller 84 is positioned below the heating roller 82, and presses the sheet of recording paper P against the outer peripheral surface of the heating roller 82.

Transporting rollers 40 that transport the sheet of recording paper P to the paper output unit 15 or the reversing unit 30 are provided downstream of the fixing device 80. Toner cartridges 78Y, 78M, 78C, 78K, 78E, and 78F that respectively contain yellow (Y) toner, magenta (M) toner, cyan (C) toner, black (K) toner, toner of the first specific color (E), and toner of the second specific color (F) are arranged in the horizontal direction in a replaceable manner in an area below the original-document reading device 56 and above the developing device 70.

In addition, a cleaning device 150 is provided to remove and collect toner (an example of developer) that remains on the surface of the transfer belt 100 instead of being transferred onto the sheet of recording paper P after the second transfer process.

Figure 2:
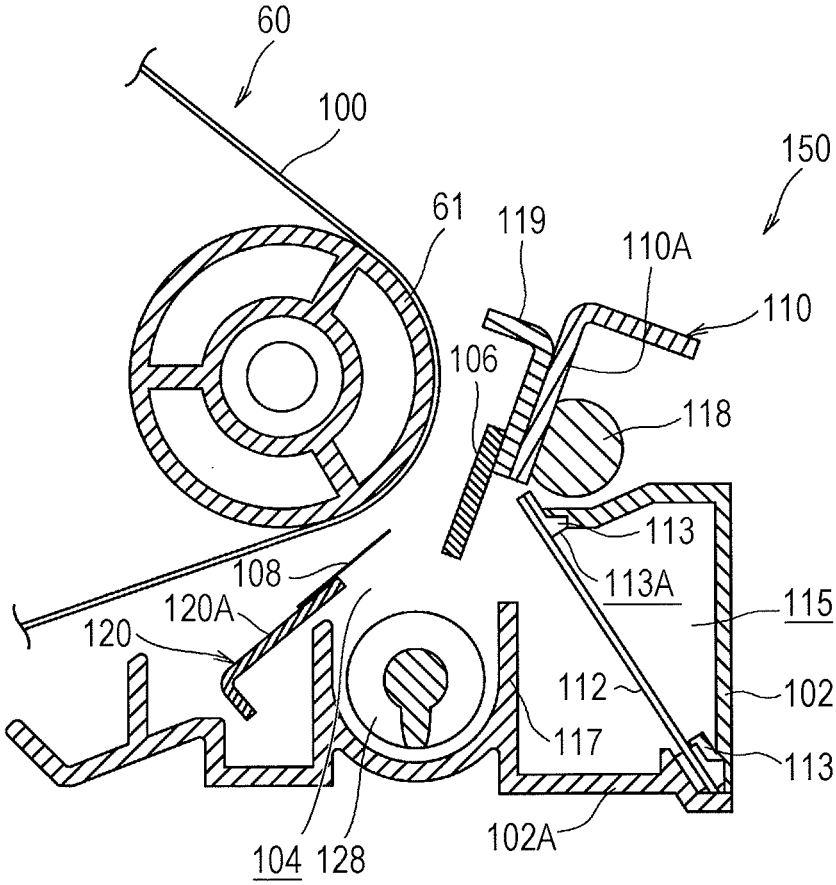
FIG. 2 is a schematic diagram illustrating a part of the image forming apparatus according to the exemplary embodiment.

Referring to FIG. 2, the cleaning device 150 includes a housing 102, a cleaning blade 106, which is an example of a removing member, and a sealing member 108. The housing 102 has a rectangular intake opening 104 that is opposed to the transfer belt 100. The cleaning blade 106 is provided at the upper side of the intake opening 104, and comes into contact with the transfer belt 100 to remove the residual toner. The sealing member 108 is provided at the side opposite to the cleaning blade 106, and comes into contact with the transfer belt 100 so as to seal a gap between the housing 102 and the transfer belt 100.

The cleaning blade 106 and the sealing member 108 may be brought into contact with and separated from the transfer belt 100.

The cleaning device 150 is connected to a suction unit 160 (see FIG. 4) for sucking the residual toner and the like that have been removed by the cleaning blade 106 (hereinafter referred to simply as "residual toner" or "toner") into the housing 102 through the intake opening 104. The cleaning device 150 includes a transporting member 128, a filter 112, and a part of a retracting mechanism 130. The transporting member 128 transports the toner collected into the housing 102 to an end of the housing 102 in a longitudinal direction thereof. The filter 112 is disposed in the housing 102 to capture dust including the toner. The retracting mechanism 130 moves the cleaning blade 106 and the sealing member 108 between a position at which the cleaning blade 106 and the sealing member 108 are in contact with the surface of the transfer belt 100 and a position at which the cleaning blade 106 and the sealing member 108 are separated from the surface of the transfer belt 100.

Side plates 114 and 116 (see FIG. 3) are attached to the housing 102 at the ends thereof in the longitudinal direction. Referring to FIG. 2, a first movable member 110 made of a metal plate that is L-shaped in cross section is provided in the upper area of the housing 102. The first movable member 110 is arranged such that it is inverted-V-shaped, and includes an inclined portion 110A (portion that extends toward the lower left in FIG. 2). A supporting shaft 118 is fixed to the back surface of the inclined portion 110A.

The supporting shaft 118 is rotatably supported at the ends thereof by bearings (not shown) provided on the side plates 114 and 116. A supporting plate 119 made of a metal plate that is L-shaped in cross section is attached to the top surface of the inclined portion 110A of the first movable member 110. An end portion (top end portion) of the cleaning blade 106 in the short-side direction thereof is fixed to the bottom end of the supporting plate 119 by adhesion. The cleaning blade 106 is arranged so as to extend along the inclination direction of the inclined portion 110A.

The cleaning blade 106 is a rectangular plate made of resin, and is attached to the supporting plate 119 such that the longitudinal direction of the cleaning blade 106 extends in the longitudinal direction of the intake opening 104. Thus, the cleaning blade 106 is provided along the edge of the intake opening 104 at the downstream end thereof in the transporting direction of the transfer belt 100.

When the retracting mechanism 130, which will be described below, is not activated, the cleaning blade 106 is arranged such that a free end thereof (end that is not fixed to the supporting plate 119) is in contact with the surface of the transfer belt 100. In this state, the cleaning blade 106 removes the toner that remains on the surface of the transfer belt 100. The toner removed by the cleaning blade 106 is collected into the housing 102 through the intake opening 104.

A second movable member 120 made of a metal plate that is L-shaped in cross section is provided at the right side of the housing 102 in FIG. 2. The second movable member 120 is arranged such that it is bent so as to project leftward in FIG. 2, and includes an inclined portion 120A (portion that extends toward the lower left in FIG. 2) in an upper area thereof. A rotatable supporting shaft (not shown) is attached to the back surface of the inclined portion 120A. Thus, the second movable member 120 is supported such that the second movable member 120 is rotatable around the supporting shaft.

The second movable member 120 is moved (rotated) in association with the movement of the first movable member 110 with a time difference therefrom, as described below. An end portion (bottom end portion) of the sealing member 108 in the short-side direction thereof is fixed to the top end of the inclined portion 120A of the second movable member 120 by adhesion.

The sealing member 108 is made of, for example, a rectangular transparent film, and is disposed below the cleaning blade 106. The sealing member 108 is attached to the second movable member 120 along the edge of the intake opening 104 at the upstream end thereof in the transporting direction of the transfer belt 100. The sealing member 108 comes into contact with the surface of the transfer belt 100.

When the cleaning blade 106 is in contact with the transfer belt 100 and when the retracting mechanism 130 starts to activate as described below, the sealing member 108 maintains the state in which a free end thereof (end that is not attached to the second movable member 120) is in contact with the surface of the transfer belt 100. Thus, the sealing member 108 seals the gap between the housing 102 and the transfer belt 100.

The housing 102 is provided with an attachment member 113 for attaching the filter 112, which will be described below, to the housing 102. The attachment member 113 is a frame-shaped member obtained by forming plural openings 113A, which are through holes, in a rectangular plate along the longitudinal direction of the plate.

The attachment member 113 is disposed in the housing 102 in an inclined manner such that a lower portion of the attachment member 113 is farther away from the transfer belt 100 and the intake opening 104 than an upper portion thereof. The attachment member 113 sections the housing 102 such that a suction path 115 having an inverted triangular shape is provided at the right side of the housing 102 in FIG. 2. The filter 112 is attached to the attachment member 113 disposed in the housing 102.

The first filter 112 is a fiber assembly, and is formed in a rectangular shape that is long in the longitudinal direction of the housing 102. The first filter 112 is bonded to the attachment member 113 and is disposed between the intake opening 104 and the suction path 115 in the housing 102 in an inclined manner such that a lower portion of the filter 112 is farther away from the intake opening 104 than an upper portion thereof. A partition wall 117 is provided on a bottom wall 102A of the housing 102 at a position between the intake opening 104 and the first filter 112.

The transporting member 128, which rotates to transfer the toner in the housing 102, is disposed between the partition wall 117 and the second movable member 120 in the lower area of the housing 102. Thus, the toner collected into the housing 102 is transported toward the back side of the apparatus body 10A.

Figure 3:
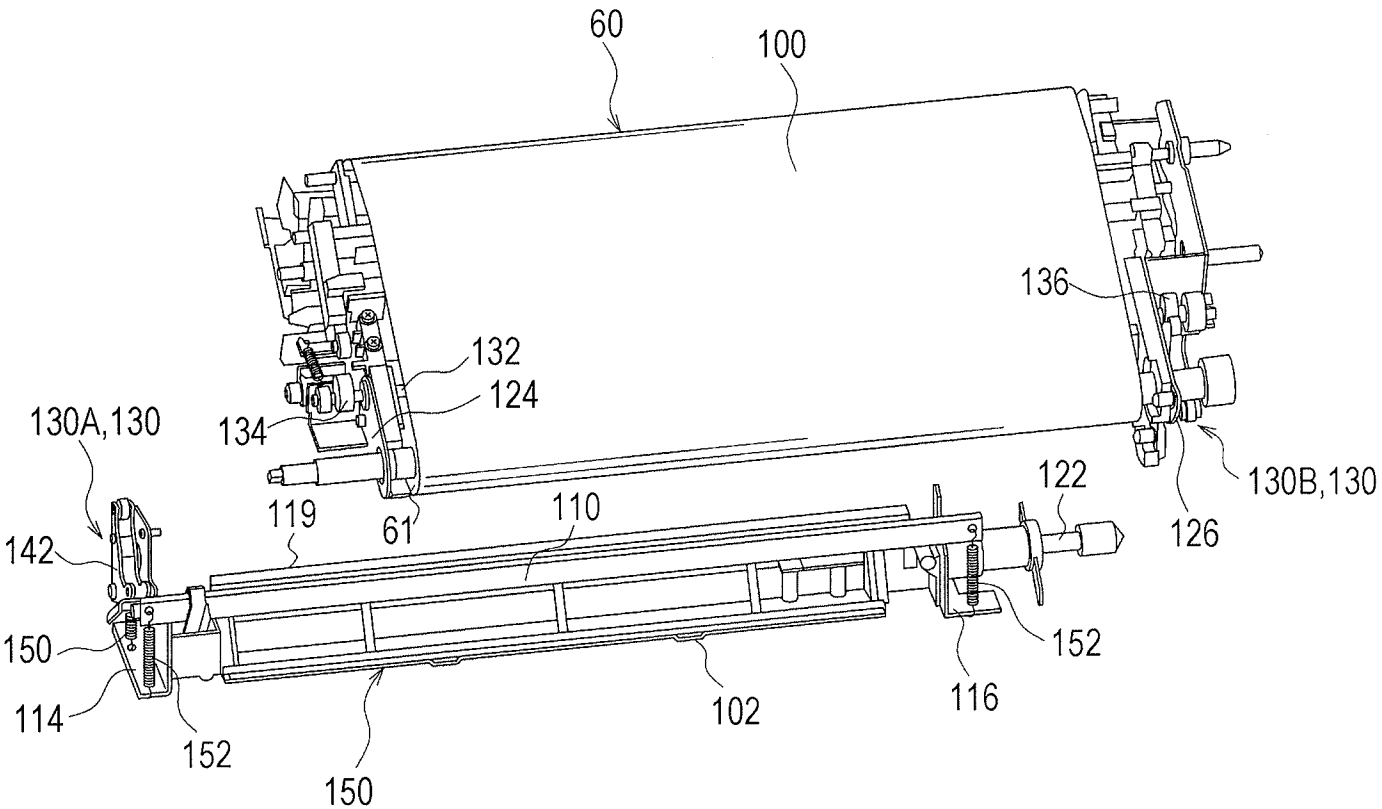
FIG. 3 is a perspective view illustrating an intermediate transfer unit and a cleaning device included in the image forming apparatus according to the exemplary embodiment.

As illustrated in FIG. 3, a cylindrical collection path 122 is provided at a position close to the back side (outer side) of the apparatus body 10A than the side plate 116 of the housing 102. The collection path 122 is connected to the transporting member 128, and the toner collected into the housing 102 is transported to a collection tank (not shown) by the transporting member 128 through the collection path 122.

Referring to FIG. 3, the retracting mechanism 130 includes a first separating mechanism 130A provided on the cleaning device 150 at the front side of the apparatus body 10A and a second separating mechanism 130B provided on the intermediate transfer unit 60 at the back side of the apparatus body 10A. Here, illustration and explanation of the second separating mechanism will be omitted.

The intermediate transfer unit 60 is provided with a side plate 124 at the front side of the cleaning device 150, and is provided with a side plate 126 at a side opposite to an extraction side of the cleaning device 150 (at the back side of the cleaning device 150).

Coil springs 152 are provided at the extraction side and the side opposite to the extraction side of the first movable member 110 at the downstream end thereof. The coil springs 152 are attached to the first movable member 110 at one end thereof and to the bottom portions of the side plates 114 and 116 at the other end thereof.

Thus, the first movable member 110 receives a rotational force in a direction such that the cleaning blade 106 is pressed against the transfer belt 100.

The first separating mechanism 130A includes a first eccentric cam 134 and a first link member 142, which is an example of a first pushing member. The first eccentric cam 134 is provided on an end portion of a cam shaft 132 that projects outward (forward) from the side plate 124 of the intermediate transfer unit 60. The first link member 142 is rotatably provided on the outer surface of the side plate 114 of the cleaning device 150. The first link member 142 is moved (rotated) by being pushed by the first eccentric cam 134 that rotates, and moves the first movable member 110 and the second movable member 120 in a direction away from the transfer belt 100.

The cam shaft 132 is an example of a rotational shaft, and is rotatably supported on the side plates 124 and 126, which are parts of a frame 300 of the intermediate transfer unit 60.

Figure 4:
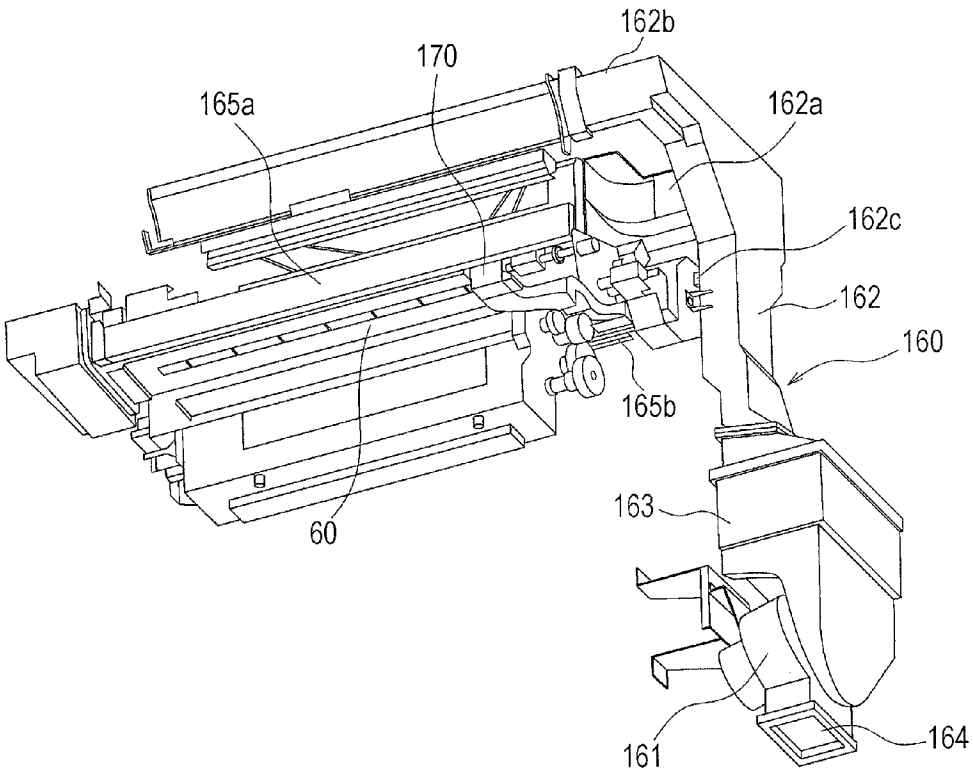
FIG. 4 is a perspective view illustrating a suction mechanism for sucking toner removed from the intermediate transfer unit illustrated in FIG. 3.

As described above, the image forming apparatus PR1 includes the suction unit 160. Referring to FIG. 4, the suction unit 160 serves to suck the toner that is in the air inside the apparatus and the residual toner that has been removed by the cleaning blade 106 of the cleaning device 150. For this purpose, the suction unit 160 includes a suction fan 161 (an example of a suction member) for sucking the toner and a suction duct 162 for guiding the toner to the suction fan 161. A filter box 163 to which a filter (not shown) is attached is disposed in front of the suction fan 161 in the suction direction. The filter (not shown) captures the toner and the like that have been sucked by the suction fan 161 and flowed through the suction duct 162. The filter attached to the filter box 163 is made of a fiber assembly having a mesh that is finer than that of the filter 112 attached to the attachment member 113 in the housing 102. Therefore, the air that does not substantially contain the toner or the like is ejected from an outlet 164 of the suction unit 160.

An upstream part of the suction duct 162 in a suction direction is divided into three branching ducts 162*a*, 162*b*, and 162*c*. Dust including the toner in the air inside the apparatus is sucked into the branching ducts 162*a* and 162*b*, and the toner that has been removed by the cleaning blade 106 of the cleaning device 150 and passed through the filter 112 is sucked into the branching duct 162*c*.

An end of a duct (an example of a guiding pipe) 170 is connected to an end of the above-described suction path 115 in the housing 102 in the longitudinal direction thereof. The other end of the duct 170 is connected to the upstream end of the branching duct 162*c* in the suction direction.

When the suction fan 161 is rotated, a suction force is applied to the inner space of the housing 102 so that the toner that has been removed by the cleaning blade 106 is collected into the housing 102 through the intake opening 104. A part of the toner that has been collected is captured by the filter 112. Another part of the toner passes through the filter 112 without being captured by the filter 112, flows through the suction path 115, and enters the duct 170. Then, the toner is guided into the suction duct 162 through the duct 170 and the branching duct 162*c*. Then, the toner is captured by the filter attached to the filter box 163, so that clean air is discharged from the outlet 164.

Figure 5:
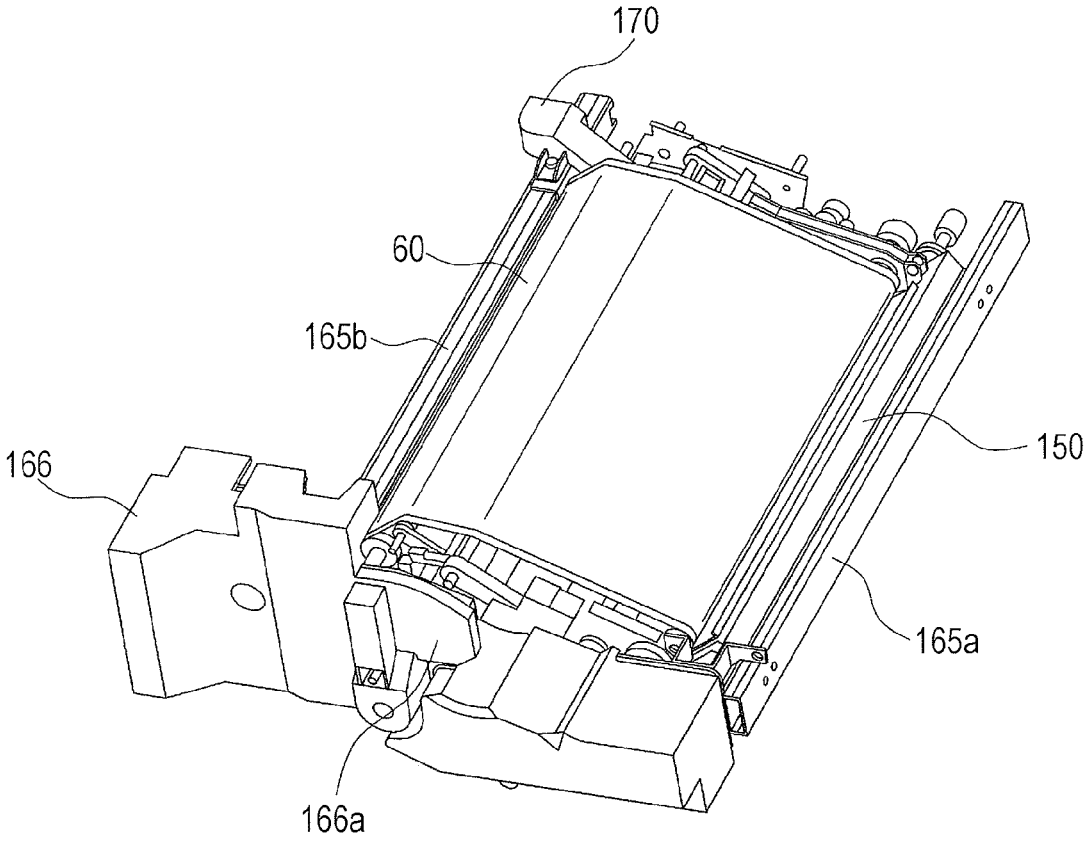
FIG. 5 is a perspective view illustrating a section of the image forming apparatus in which the intermediate transfer unit and the cleaning device illustrated in FIG. 3 are attached.
Figure 6:
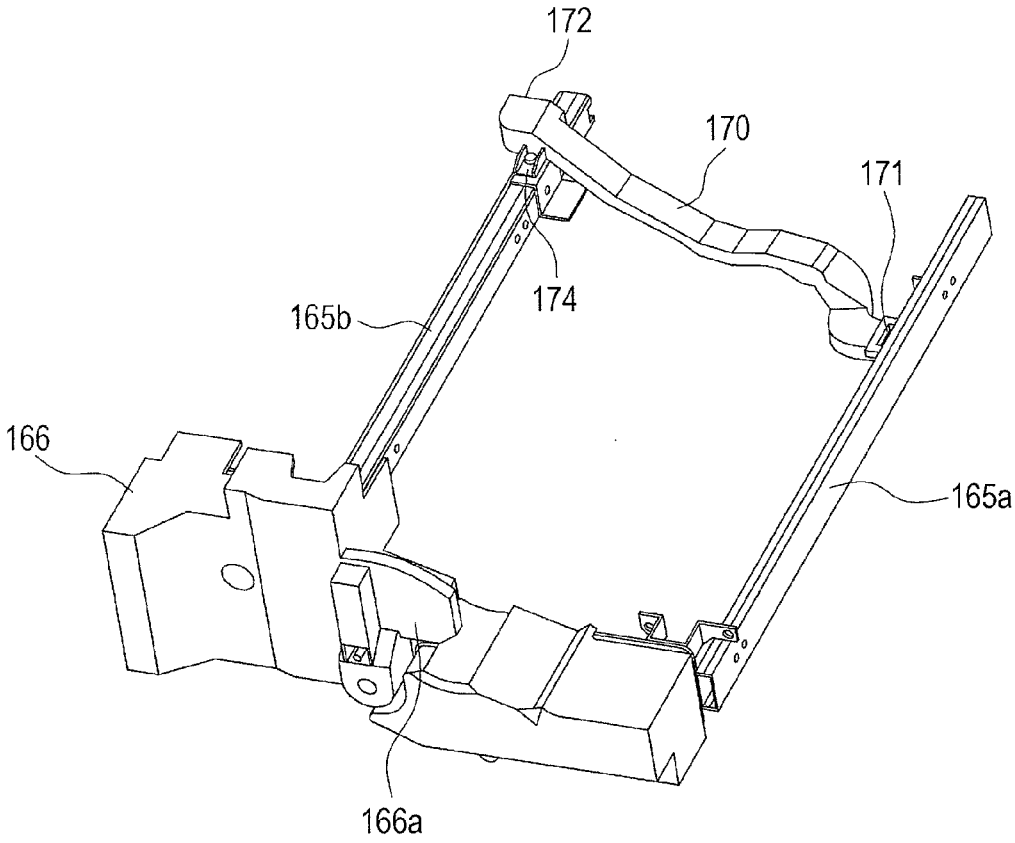
FIG. 6 is a perspective view illustrating the structure of the section in which the intermediate transfer unit and the cleaning device illustrated in FIG. 3 are attached.

Referring to FIGS. 5 and 6, the intermediate transfer unit 60 and the cleaning device 150 are fixed to each other with screws, and may be attached to or detached from the apparatus by being guided by a pair of guide rails 165*a* and 165*b* provided on the apparatus body 10A. The above-described duct 170 is fixed with screws to the guide rails 165*a* and 165*b* such that the duct 170 extends between the ends of the guide rails 165*a* and 165*b* at the insertion side of the intermediate transfer unit 60 and the cleaning device 150. A supporting member 166 is provided at the ends of the guide rails 165*a* and 165*b* at the extraction side of the intermediate transfer unit 60 and the cleaning device 150. The supporting member 166 supports the guide rails 165*a* and 165*b* together with the duct 170 such that the guide rails 165*a* and 165*b* face each other, and includes a lock portion 166*a* that retains the intermediate transfer unit 60 and the cleaning device 150 at predetermined positions.

In the image forming apparatus PR1 including the developing device 70 of the rotary type as in the present exemplary embodiment, the cleaning blade 106 repeatedly comes into contact with and moves away from the transfer belt 100 in the developing process. In this process, if the toner (an example of developer) that stays in the air after being removed by the cleaning blade 106 adheres to the transfer belt 100 again, the quality of the image will be reduced. To prevent the toner from adhering to the transfer belt 100 again, the air in the cleaning device 150 is sucked by the suction unit 160.

To suck the toner in the air, the suction fan 161 is required to generate a suction force that is large enough to suck the toner in the air. If the filter 112 in the housing 102 has a mesh that is fine enough to prevent the toner from being discharged to the outside, the flow rate decreases. Therefore, it is difficult to prevent the toner from being discharged to the outside while maintaining the flow rate.

Accordingly, in the image forming apparatus PR1, the duct 170 is also used to capture the toner, so that the toner may be captured and prevented from being discharged to the outside without reducing the flow rate.

The duct 170 will be described below with reference to FIGS. 7 to 11.

As shown in FIGS. 7 to 11, the duct 170, from which the air is sucked by the suction fan 161, has a suction hole 171 and an outlet 172. The toner that has been sucked into the housing 102 (more specifically, the toner that has been sucked into the housing 102 through the intake opening 104 and entered the suction path 115 without being captured by the filter 112) is sucked into the duct 170 through the suction hole 171 and is discharged from the duct 170 through the outlet 172. The duct 170 is provided with flanges 174 at the ends thereof near the suction hole 171 and the outlet 172. Screw holes 174*a* used to fix the duct 170 to the guide rails 165*a* and 165*b* with screws are formed in the flanges 174.

Figure 7:
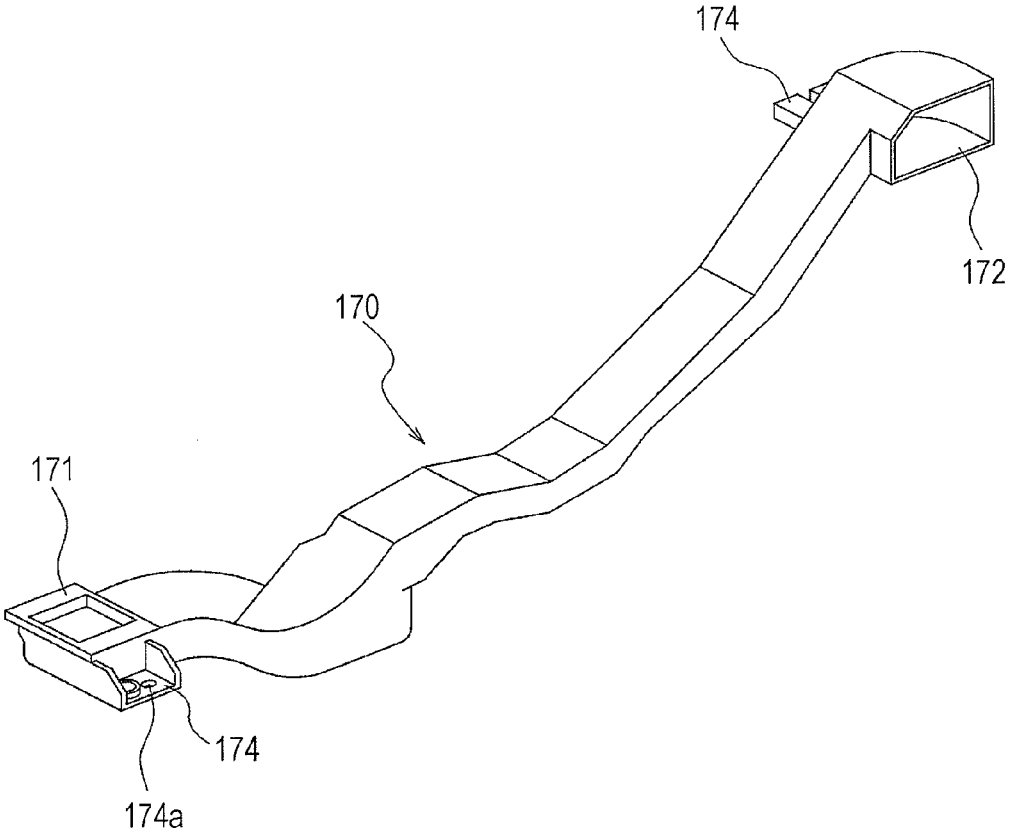
FIG. 7 is a perspective view illustrating a duct attached to the image forming apparatus according to the exemplary embodiment.
Figure 8:
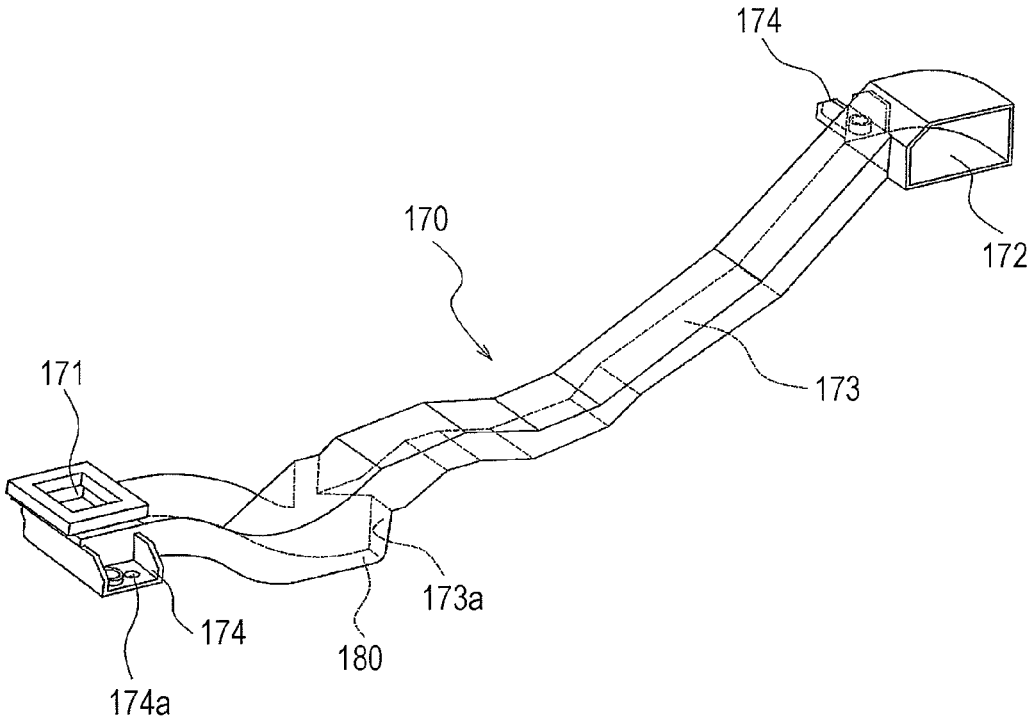
FIG. 8 is a perspective view illustrating the inner structure of the duct illustrated in FIG. 7 in a see-through manner.

Referring to FIGS. 7 and 8, the suction hole 171 in the duct 170 opens upward. An upstream end of a flow channel 173 from the suction hole 171 to the outlet 172 extends in a direction that crosses the direction in which the suction hole 171 opens. The flow channel 173 is curved (bent) in a horizontal direction (rightward in FIG. 7) from the position of the suction hole 171, extends through a capturing area 180, which will be described below, and is bent in a direction along the upstream end of the flow channel 173. Then, the flow channel 173 extends upward to the outlet 172. The outlet 172 opens in a horizontal direction with respect to the flow channel 173. Thus, a downstream end of the flow channel 173 extends in a direction that crosses the direction in which the outlet 172 opens.

The flow channel 173 is slightly bent at several positions in an area from the capturing area 180 to the downstream end of the flow channel 173. This is to avoid interference between the flow channel 173 and other components when the duct 170 is attached to the image forming apparatus PR1.

Figure 9:
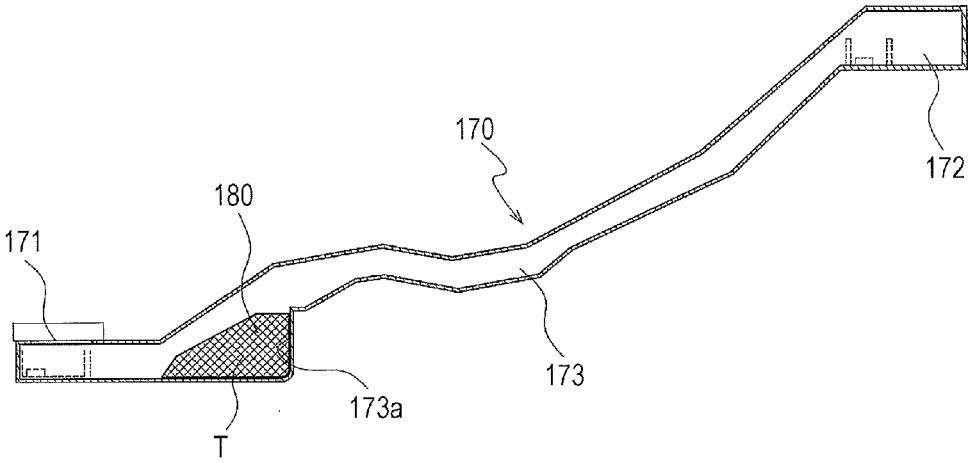
FIG. 9 is a side view illustrating the inner structure of the duct illustrated in FIG. 7 in a see-through manner.
Figure 10:
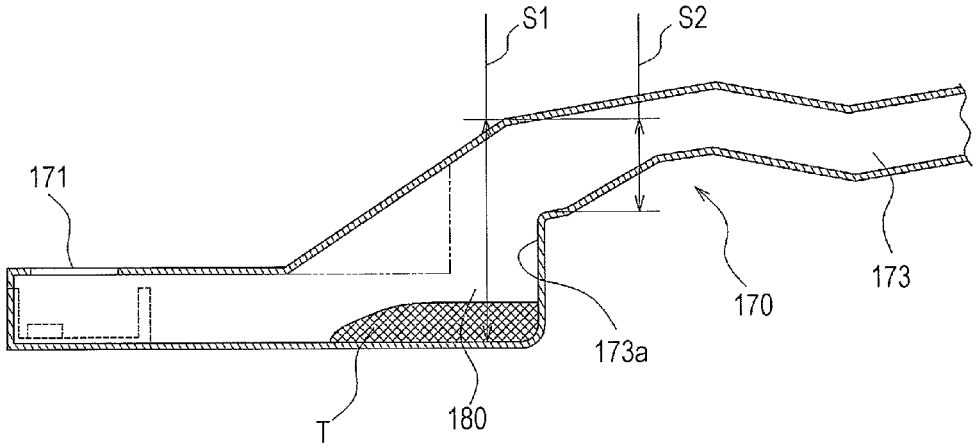
FIG. 10 is a side view illustrating a part of the duct illustrated in FIG. 9.

Referring to FIG. 9, the capturing area 180 is provided in the flow channel 173 at an intermediate position between the suction hole 171 and the outlet 172 of the duct 170. The cross section of the capturing area 180 in the radial direction of the flow channel 173 is larger than that of other areas. Since the cross section of the capturing area 180 is large, the air velocity decreases in the capturing area 180. Accordingly, the velocity of the toner that is sucked in by the suction fan 161 and flows through the flow channel 173 also decreases, so that the toner is captured. In FIGS. 9 and 10, the toner captured in the capturing area 180 is denoted by T.

More specifically, in the present exemplary embodiment, a portion having a stepped shape (hereinafter referred to as a "stepped portion") 173*a* is provided in the capturing area 180. Owing to the stepped portion 173*a*, the cross section of the capturing area 180 is larger than that of other areas. The stepped portion 173*a* is shaped so as to face the direction in which the toner flows, so that the toner that flows through the flow channel 173 hits the stepped portion 173*a*.

Referring to FIG. 10, a cross section S1 of the capturing area 180 in the radial direction of the flow channel 173 at the stepped portion 173*a* is about 9.0 $cm^2$. A cross section S2 of an area other than the capturing area 180, for example, an area behind the stepped portion 173*a* in the direction in which the toner flows, is about 3.7 $cm^2$ in the radial direction of the flow channel 173 (about 41% of the cross section S1 at the stepped portion 173*a*). The present invention is, of course, not limited to the numerical values mentioned in the present exemplary embodiment, including the numerical values mentioned in the examples described below.

When the cross section of the capturing area 180 in the radial direction is larger than that of other areas, the air velocity decreases in the capturing area 180. Accordingly, the velocity of the toner that is sucked in by the suction fan 161 and flows through the flow channel 173 also decreases, so that the toner is captured and the air flows over the captured toner.

In addition, the stepped portion 173*a* is provided in the capturing area 180, so that the toner that flows through the flow channel 173 hits the stepped portion 173*a*. The toner that flows through the duct 170 falls after hitting the stepped portion 173*a*. Thus, the amount of toner that may be captured is increased.

As described above, the toner is captured in the capturing area 180 in the duct 170. Therefore, a filter having a relatively coarse mesh may be used as the filter 112 in the housing 102, so that the flow rate does not decrease in the duct 170. Because the toner is captured in the capturing area 180 in the duct 170, the amount of toner that reaches the filter at the suction fan 161 is reduced. As a result, the replacement cycle of the filter is increased and the running cost is reduced.

In the present exemplary embodiment, the stepped portion 173*a* is shaped such that the cross section suddenly changes. However, the shape of the stepped portion 173*a* is not limited to this. For example, an inclined surface (a planar or curved surface that is inclined) may be formed such that the cross section gradually changes.

The capturing area 180 is not limited as long as the cross section thereof in the radial direction of the flow channel 173 is larger than that of other areas. The flow channel 173 may be, for example, two-dimensionally or three-dimensionally bent so that the cross section of the capturing area 180 in the radial direction is larger than that of other areas. Alternatively, a stepped portion may be formed in addition to two-dimensionally or three-dimensionally bending the flow channel 173 so that the cross section of the capturing area 180 in the radial direction is larger than that of other areas.

In such a case, in addition to the effect that the air velocity decreases in the capturing area 180 and the velocity of the toner that flows through the flow channel 173 decreases as a result, the following effect may be obtained. That is, the toner that has failed to follow the air that flows along the two-dimensionally or three-dimensionally bent portion of the flow channel 173 hits the inner wall surface of the duct 170, so that the velocity of the toner decreases. As a result, the amount of toner that may be captured is increased.

Figure 11:
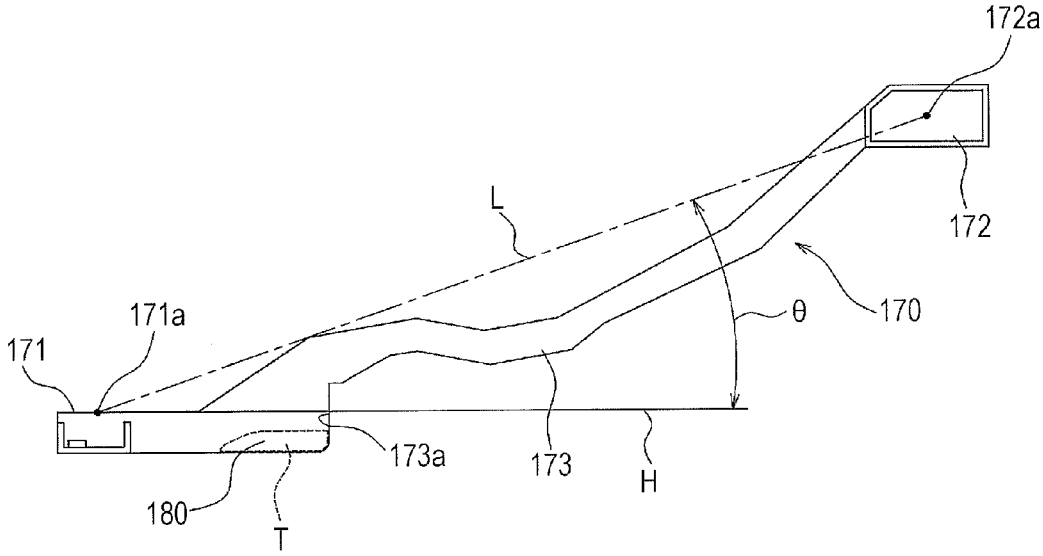
FIG. 11 is a diagram illustrating the manner in which the duct attached to the image forming apparatus according to the exemplary embodiment is inclined.

In FIG. 11, the line L that connects the center 171*a* of the suction hole 171 to the center 172*a* of the outlet 172 is inclined upward with respect to the suction hole 171. In the present exemplary embodiment, the angle between the horizontal line H and the line L, that is, the inclination angle θ of the line L, is about 20 degrees.

Since the duct 170 is inclined upward as described above, the toner in the duct 170 is caused to flow upward. Therefore, the toner easily adheres to the bottom surface of the duct 170 and the amount of toner that may be captured is increased.

In addition, as described above, the duct 170 is fixed with screws to the guide rails 165*a* and 165*b*, and is detachable independently of the other components of the image forming apparatus PR1. Accordingly, the duct 170 may be detached from the image forming apparatus PR1 for cleaning. Thus, maintenance of the duct 170 is facilitated.

In the above-described exemplary embodiment, the present invention is applied to an image forming apparatus using the cycle method, in which toner images of respective colors are successively formed by a single image forming unit and are successively transferred onto an intermediate transfer body in a first transfer process, so that the toner images are superimposed on a transfer belt. However, the present invention is not limited to the image forming apparatus using the cycle method, and may be applied to various types of image forming apparatuses, such as a tandem image forming apparatus which includes a photoconductor and an optical unit for each color and in which toner images are transferred from the photoconductors of the respective colors in synchronization with the movement of a sheet of recording paper on a transfer belt.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiment and with the various modifications as are suited to the particular use contemplated. It is intended that the scope of the invention be defined by the following claims and their equivalents.

What is claimed is:

1. An image forming apparatus comprising:

a transfer member that retains developer;

a housing provided with a removing member that removes the developer, the housing having an intake opening that is opposed to the transfer member, the developer removed by the removing member being taken into the housing through the intake opening;

a guiding pipe connected to the housing and having a suction hole through which the developer that has been taken into the housing is sucked and an outlet through which the developer that has been sucked is discharged; and a suction member that applies a suction force to an inner space of the housing through the guiding pipe, wherein the guiding pipe comprises:

a capturing area configured to capture the developer that has been sucked by the suction member and that flows through a flow channel from the suction hole to the outlet of the guiding pipe and provided at an intermediate position of the flow channel, a cross section of the capturing area being larger than a cross section of other areas of the guiding pipe, and a portion of the guiding pipe that turns a horizontal direction and is provide upstream position from the capturing area in the flow channel.

2. The image forming apparatus according to claim 1, wherein the capturing area comprises a stepped portion, and the developer that flows through the flow channel hits the stepped portion.

3. The image forming apparatus according to claim 1, wherein the flow channel is two-dimensionally or three-dimensionally bent in the capturing area.

4. The image forming apparatus according to claim 2, wherein the flow channel is two-dimensionally or three-dimensionally bent in the capturing area.

5. The image forming apparatus according to claim 1, wherein a line that connects the center of the suction hole and the center of the outlet to each other is inclined upward with respect to the suction hole.

6. The image forming apparatus according to claim 2, wherein a line that connects the center of the suction hole and the center of the outlet to each other is inclined upward with respect to the suction hole.

7. The image forming apparatus according to claim 3, wherein a line that connects the center of the suction hole and the center of the outlet to each other is inclined upward with respect to the suction hole.

8. The image forming apparatus according to claim 4, wherein a line that connects the center of the suction hole and the center of the outlet to each other is inclined upward with respect to the suction hole.

9. The image forming apparatus according to claim 1, wherein the guiding pipe is detachable.

10. The image forming apparatus according to claim 2, wherein the guiding pipe is detachable.

11. The image forming apparatus according to claim 3, wherein the guiding pipe is detachable.

12. The image forming apparatus according to claim 4, wherein the guiding pipe is detachable.

13. The image forming apparatus according to claim 5, wherein the guiding pipe is detachable.

14. The image forming apparatus according to claim 6, wherein the guiding pipe is detachable.

15. The image forming apparatus according to claim 7, wherein the guiding pipe is detachable.

16. The image forming apparatus according to claim 8, wherein the guiding pipe is detachable.

17. The image forming apparatus according to claim 1, wherein the portion of the guiding pipe is configured to bend a flow direction of the developer in the horizontal direction toward the capturing area.

18. The image forming apparatus according to claim 1, wherein the portion of the guiding pipe is disposed adjacent to the capturing area.

19. The image forming apparatus according to claim 2, wherein the cross section of the capturing area continuously increases from an inlet portion of the capturing area to an outlet portion of the capturing area.

20. The image forming apparatus according to claim 1, wherein the developer that goes through the portion of the guiding pipe that turns in the horizontal direction flows upward in the capturing area.

* * * * *